US010363768B2

(12) United States Patent
Wu et al.

(10) Patent No.: US 10,363,768 B2
(45) Date of Patent: Jul. 30, 2019

(54) IDENTIFICATION DOCUMENT WITH CONTOURED SURFACE IMAGE

(71) Applicant: MorphoTrust USA, LLC, Billerica, MA (US)

(72) Inventors: Yecheng Wu, Lexington, MA (US); Robert Jones, Andover, MA (US); William M. O'Connor, Derry, NH (US)

(73) Assignee: MorphoTrust USA, LLC, Billerica, MA (US)

( * ) Notice: Subject to any disclaimer, the term of this patent is extended or adjusted under 35 U.S.C. 154(b) by 0 days.

(21) Appl. No.: 15/729,207

(22) Filed: Oct. 10, 2017

(65) Prior Publication Data

US 2018/0099521 A1 Apr. 12, 2018

Related U.S. Application Data

(60) Provisional application No. 62/406,364, filed on Oct. 10, 2016.

(51) Int. Cl.
*B42D 25/309* (2014.01)
*B42D 25/324* (2014.01)
(Continued)

(52) U.S. Cl.
CPC ..... *B42D 25/435* (2014.10); *B42D 25/23* (2014.10); *B42D 25/309* (2014.10);
(Continued)

(58) Field of Classification Search
CPC .... B42D 25/309; B42D 25/324; B42D 25/43; B42D 25/435; B42D 25/44; B42D 25/445
(Continued)

(56) References Cited

U.S. PATENT DOCUMENTS 5,298,922 A * 3/1994 Merkle ..... B42D 25/324 283/85
5,421,619 A * 6/1995 Dyball ..... B42D 25/435 283/77
(Continued)

FOREIGN PATENT DOCUMENTS

DE 3231460 A1 * 3/1984 ..... B42D 25/324
FR 3012366 A1 * 5/2015 ..... B42D 25/43
(Continued)

OTHER PUBLICATIONS

FR-3012366 Translation (Year: 2015).*
International Search Report and Written Opinion in International Application No. PCT/US2017/055922, dated Jan. 10, 2018, 12 pages.

*Primary Examiner* — Kyle R Grabowski
(74) *Attorney, Agent, or Firm* — Fish & Richardson P.C.

(57) ABSTRACT

A multilayer laminate identification document including an outer layer having a contoured surface image formed therein via laser ablation. The contoured surface image has contours based on a digital monochrome image, and has a first appearance when viewed in reflected light at a first angle and a second, different appearance when viewed in reflected light at a second, different angle. The multilayer laminate identification document is formed by generating a second digital monochrome image with continuous pixel patterns from a first digital monochrome image, and irradiating the surface of the identification document with a laser using the second digital monochrome image as a guide to form a contoured surface image in the surface of the identification document.

5 Claims, 5 Drawing Sheets

(51) Int. Cl.

| | |
|---|---|
| ***B42D 25/43*** | (2014.01) |
| ***B42D 25/435*** | (2014.01) |
| ***B42D 25/44*** | (2014.01) |
| ***B42D 25/445*** | (2014.01) |
| ***B42D 25/23*** | (2014.01) |
| ***B42D 25/46*** | (2014.01) |
| ***B42D 25/455*** | (2014.01) |
| *B42D 25/24* | (2014.01) |
| *B42D 25/29* | (2014.01) |

(52) U.S. Cl.
CPC ..... *B42D 25/324* (2014.10); *B42D 25/43* (2014.10); *B42D 25/44* (2014.10); *B42D 25/445* (2014.10); *B42D 25/455* (2014.10); *B42D 25/46* (2014.10); *B42D 25/24* (2014.10); *B42D 25/29* (2014.10)

(58) Field of Classification Search
USPC ..... 283/77
See application file for complete search history.

(56) References Cited

U.S. PATENT DOCUMENTS

| | | | | |
|---|---|---|---|---|
| 8,651,656 | B2 * | 2/2014 | Roof | B41J 3/32 283/74 |
| 2005/0072849 | A1 | 4/2005 | Jones | |
| 2011/0057040 | A1 | 3/2011 | Jones et al. | |
| 2013/0099474 | A1 * | 4/2013 | Fuhse | B42D 25/324 283/85 |
| 2013/0182300 | A1 * | 7/2013 | Muller | B42D 25/425 359/2 |
| 2016/0176219 | A1 * | 6/2016 | Nijssen | B42D 25/41 283/77 |

FOREIGN PATENT DOCUMENTS

| | | | | |
|---|---|---|---|---|
| WO | 2005024699 | | 3/2005 | |
| WO | WO-2011131295 | A1 * | 10/2011 | B42D 25/324 |

* cited by examiner

IDENTIFICATION DOCUMENT WITH CONTOURED SURFACE IMAGE

CROSS-REFERENCE TO RELATED APPLICATION

This application claims the benefit of U.S. Application Ser. No. 62/406,364 entitled "IDENTIFICATION DOCUMENT WITH CONTOURED SURFACE IMAGE" and filed on Oct. 10, 2016, which is incorporated by reference herein in its entirety.

TECHNICAL FIELD

This disclosure generally relates to security features for identification ("ID") documents.

BACKGROUND

Identification ("ID") documents play a critical role in today's society. One example of an ID document is an ID card. ID documents are used on a daily basis to prove identity, to verify age, to access a secure area, to evidence driving privileges, to cash a check, and so on. Airplane passengers are required to show an ID document during check in, security screening, and prior to boarding a flight. In addition, because we live in an ever-evolving cashless society, ID documents are used to make payments, access an automated teller machine (ATM), debit an account, make a payment, and the like.

SUMMARY

In a first general aspect, a multilayer laminate identification document includes an outer layer having a contoured surface image formed via laser ablation. The contoured surface image has contours based on a digital monochrome image, and has a first appearance when viewed in reflected light at a first angle and a second, different appearance when viewed in reflected light at a second, different angle.

Implementations of the first general aspect may include one or more of the following features.

The multilayer laminate may include an inner layer having a source image printed thereon, where the digital monochrome image is derived from the source image. The source image may be a digital monochrome image (e.g., a grayscale image) or a digital polychrome image. In one example, the source image is a digital color portrait image. In some cases, the contoured surface image partially overlaps the source image. In certain cases, the contoured surface image does not overlap the source image. The contoured surface image is typically perceptible by touch. The contours of the contoured surface image do not appear pixelated to the unaided human eye. The contoured surface image may be invisible when viewed in reflected light at a third angle, where the third angle is different from the first angle and the second angle. The contours of the contoured surface image may be continuous, and may correspond to contiguous pixels in the digital monochrome image. The contoured surface image defines a depression in the outer layer.

In a second general aspect, a computer-implemented method for forming a contoured surface image on a surface of an identification document is executed by one or more processors. The method includes generating, by the one or more processors, a second digital monochrome image with continuous pixel patterns from a first digital monochrome image; and causing, by the one or more processors, laser irradiation of the surface of the identification document using the second digital monochrome image as a guide to form the contoured surface image in the surface of the identification document.

Implementations of the second general aspect may include one or more of the following features, which may be accomplished by the one or more processors.

A source image may be converted to yield the first digital monochrome image. The source image may include a digital polychrome image, such as a digital color portrait image of a subject. In some cases, the digital color portrait image of the subject is obtained before converting the digital color portrait image of the subject to yield the first digital monochrome image. In certain cases, the contrast of the first digital monochrome image is enhanced before generating the second digital monochrome image. The image resolution of the first digital monochrome image may be adjusted before generating the second digital monochrome image. Generating the second digital monochrome image may include adding noise to the first digital monochrome image. Adding the noise to the first digital monochrome image may include coupling adjacent or directly adjacent (abutting) pixels of the first digital monochrome image.

In some cases, the laser irradiation of the surface of the identification document ablates a portion of the surface of the identification document. In certain cases, the laser irradiation of the surface of the identification document melts a portion of the surface of the identification document corresponding to a first pixel of the second digital monochrome image. The melted portion of the surface of the identification document corresponding to the first pixel of the second digital monochrome image may flow to a surface of the identification document corresponding to a second pixel of the second digital monochrome image, where the first pixel is adjacent or directly adjacent to the second pixel.

Using the second digital monochrome image as a guide may include irradiating portions of the surface of the identification document corresponding to a subset of pixels of the second digital monochrome image. In some cases, the second digital monochrome image is a grayscale image. When the second digital monochrome image is a grayscale image, using the second digital monochrome image as a guide may include irradiating portions of the surface of the identification document corresponding to pixels of the second digital monochrome image identified as dark or black. The laser irradiation may correspond to irradiation of the surface of the document with a laser beam, where the affected area of the laser beam exceeds the physical pixel size of the second digital monochrome image. The laser irradiation is typically from a $CO_2$ laser. The laser irradiation forms a depression in the surface of the ID document.

The details of one or more implementations of the subject matter described in this specification are set forth in the accompanying drawings and the description below. Other features, aspects, and advantages of the subject matter will become apparent from the description, the drawings, and the claims.

DETAILED DESCRIPTION

Figure 1A:
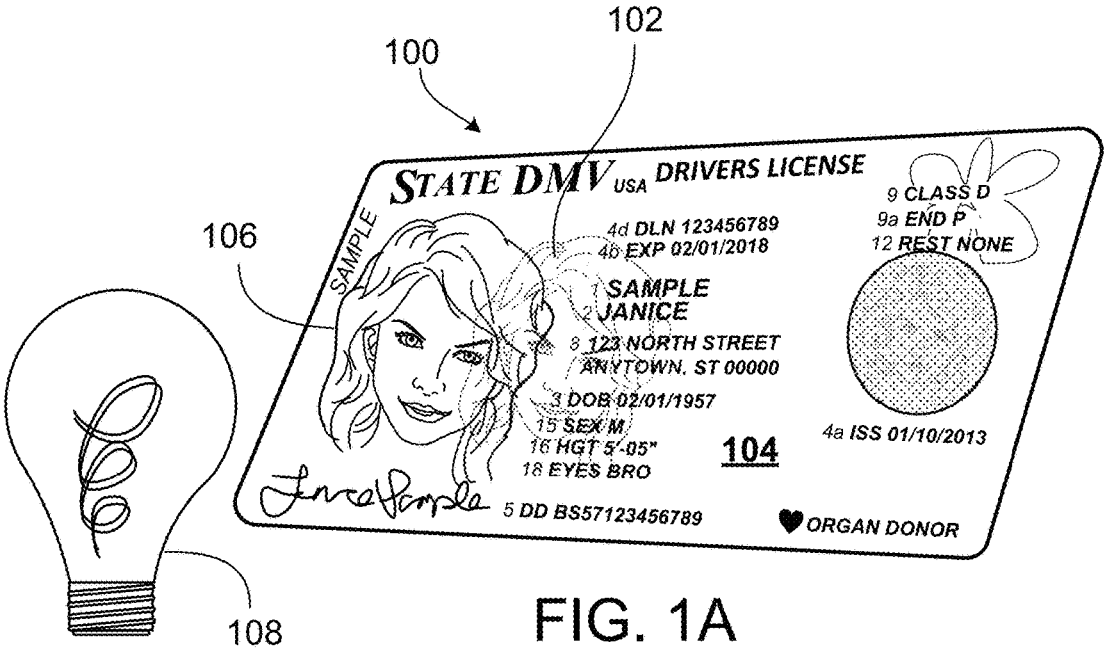
FIGS. 1A-1C depict ID documents with contoured surface images viewed from the front in reflected light at a first angle.

Implementations of the present disclosure include identification (ID) documents with a contoured surface image. As described herein, a contoured surface image is visible in light reflected from the surface in which the contoured surface image is formed. The contoured surface image is formed by irradiating portions of the surface of the ID document with a laser using a digital monochrome image as a guide. Irradiating portions of the surface of ID document includes ablating and melting portions of the surface of the ID document. As described herein, "ablating" an ID document refers to removing polymeric material from a surface of an ID document with a laser (e.g., a $CO_2$ laser). Typically, ablating an ID document does not result in discoloration of the ID document. In contrast, "engraving" refers to carbonizing rather than removing polymeric material from an ID document with a laser (e.g., a YAG laser). Engraving typically results in discoloration of the polymeric material (e.g., to yield black tactile alphanumeric characters or images on the ID document).

The contoured surface image defines a depression in the surface of the ID document, with features of the image at various depths from the outer surface of the ID document. Thus, a contoured surface image is perceptible by touch (e.g., by translating a fingertip in contact with the surface of the ID document over the contoured surface image). Pixel patterns are not apparent in the resulting contoured surface image. The appearance of a contoured surface image can change when viewed at different angles in reflected light or in different lighting conditions. That is, the appearance of a contoured surface image can change based on the incident angle of reflected light on the ID document.

Implementations of the present disclosure also include methods for generating contoured surface images on ID documents. The processes described herein generate digital images from monochrome images that can be effectively transferred to ID documents via continuous pixel contouring. In continuous pixel contouring, contoured surface images are created on ID documents by generating a digital monochrome image with continuous pixel patterns from a source image. The source image may be a digital monochrome image or a digital color image. In some cases, the source image is a digital color portrait image of an authorized user of the ID document (the "bearer"). In this process, a contoured surface image is formed in the outer surface of an ID document by introducing heat energy to a series of contiguous pixels to selectively ablate and heat the polymer of the outer layer of the ID document. The polymer is heated with a laser (e.g., a $CO_2$ laser) to an extent to allow the polymer associated with one pixel to flow into an adjacent or directly adjacent (abutting) pixel, thereby creating a smooth, contoured (or "sculpted") surface. The resulting contoured surface image is visible at specific angles of reflected light.

As efforts to counterfeit identification documents become more sophisticated, additional features are needed for secure credentialing. For example, ID documents with contoured surface images allow personalized credentials to be added to an ID document in in a manner that is difficult to reproduce without sophisticated equipment and materials. This feature provides an additional security measure to identify counterfeit ID documents and increases the difficulty associated with making a forgery. Contoured surface images may include portraits, text, graphical patterns, images, and the like, and may be printed at any location in an ID document. In some examples, the contoured surface image is a portrait of the bearer, and is superimposed over, overlaps, or is spatially separated from another image (e.g., the source image).

Physical ID documents described herein are suitable for Dye Diffusion Thermal Transfer (D2T2) personalization, laser (e.g., YAG and $CO_2$) personalization, or both. These ID documents may be "over-the-counter" documents or "central issue" documents, and may be personalized in either process. The ID documents may have transparency enhancement properties. U.S. 2011/0057040, entitled "OPTICALLY VARIABLE PERSONALIZED INDICIA FOR IDENTIFICATION DOCUMENTS" is incorporated by reference herein with respect to various features and fabrication processes related to physical ID documents.

As used herein, "ID document" is broadly defined and intended to include all types of physical and digital ID documents, including, documents, magnetic disks, credit cards, bank cards, phone cards, stored value cards, prepaid cards, smart cards (e.g., cards that include one more semiconductor chips, such as memory devices, microprocessors, and microcontrollers), contact cards, contactless cards, proximity cards (e.g., radio frequency (RFID) cards), passports, driver licenses, network access cards, employee badges, debit cards, security cards, visas, immigration documentation, national ID cards, citizenship cards, social security cards, security badges, certificates, identification cards or documents, voter registration and/or identification cards, military, police, and government ID cards or credentialing documents, school ID cards, facility access cards, border crossing cards, security clearance badges and cards, legal instruments, handgun permits (e.g., concealed handgun licenses), badges, gift certificates or cards, membership cards or badges, and tags. Also, the terms "document," "card," "badge," and "documentation" are used interchangeably throughout this disclosure. In addition, ID document can include any item of value (e.g., currency, bank notes, and checks) where authenticity of the item is important, where counterfeiting or fraud is an issue, or both.

ID documents such as driver licenses can contain information such as a photographic image, a bar code (which may contain information specific to the person whose image appears in the photographic image, and/or information that is the same from ID document to ID document), variable personal information, such as an address, signature, and/or birthdate, biometric information associated with the person whose image appears in the photographic image (e.g., a fingerprint), a magnetic stripe (which, for example, can be on the side of the ID document that is opposite the side with the photographic image), and various security features, such as a security pattern (for example, a printed pattern comprising a tightly printed pattern of finely divided printed and unprinted areas in close proximity to each other, such as a fine-line printed security pattern as is used in the printing of banknote paper, stock certificates, and the like).

In the production of images useful in the field of identification documentation, it may be desirable to embody into a document (such as an ID card, driver license, passport or the like) data or indicia representative of the document issuer (e.g., an official seal, or the name or mark of a company or educational institution) and data or indicia representative of the bearer (e.g., a photographic likeness, name or address). Typically, a pattern, logo or other distinctive marking representative of the document issuer will serve as a means of verifying the authenticity, genuineness or valid issuance of the document. A photographic likeness or other data or indicia personal to the bearer will validate the right of access to certain facilities or the prior authorization to engage in commercial transactions and activities.

As used herein, "identification" at least refers to the use of an ID document to provide identification and/or authentication of a user and/or the ID document itself. For example, in a driver license, one or more portrait images on the card are intended to show a likeness of the authorized holder of the card. For purposes of identification, at least one portrait on the card (regardless of whether or not the portrait is visible to a human eye without appropriate stimulation) preferably shows an "identification quality" likeness of the holder such that someone viewing the card can determine with reasonable confidence whether the holder of the card actually is the person whose image is on the card. "Identification quality" images, in at least one instance, include covert images that, when viewed using the proper facilitator (e.g., an appropriate light source for covert images, an appropriate temperature source for thermochromic images, etc.), provide a discernable image that is usable for identification or authentication purposes.

Certain images may be considered to be "identification quality" if the images are machine readable or recognizable, even if such images do not appear to be "identification quality" to a human eye, whether or not the human eye is assisted by a particular piece of equipment, such as a special light source. For example, in at least one implementation, an image or data on an ID document can be considered to be "identification quality" if it has embedded in it machine-readable information (such as digital watermarks or steganographic information) that also facilitate identification and/or authentication.

There are a number of reasons why an image or information on an ID document might not qualify as an "identification quality" image. Images that are not "identification quality" may be too faint, blurry, coarse, small, etc. to be able to be discernable enough to serve an identification purpose. An image that might not be sufficient as an "identification quality" image, at least in some environments, could, for example, be an image that consists of a mere silhouette of a person, or an outline that does not reveal what might be considered essential identification essential (e.g., hair color or eye color) of an individual. As such, a contoured surface image as described herein is typically not of identification quality.

Further, in at least some implementations, "identification" and "authentication" are intended to include (in addition to the conventional meanings of these words), functions such as recognition, information, decoration, and any other purpose for which an indicia can be placed upon an article in the article's raw, partially prepared, or final state. Also, in addition to ID documents, techniques described herein can be employed with product tags, product packaging, business cards, bags, charts, maps, labels, and the like, particularly those items including marking of a laminate or overlaminate structure. "ID document" thus is broadly defined herein to include these tags, labels, packaging, cards, etc.

"Personalization," "personalized data," and "variable" data are used interchangeably herein, and refer at least to data, characters, symbols, codes, graphics, images, and other information or marking, whether human readable or machine readable, that is (or can be) "personal to" or "specific to" a specific cardholder or group of cardholders. Personalized data can include data that is unique to a specific cardholder (such as biometric information, image information, serial numbers, Social Security Numbers, privileges a cardholder may have, etc.), but is not limited to unique data. Personalized data can include some data, such as birthdate, height, weight, eye color, address, etc., that are personal to a specific cardholder but not necessarily unique to that cardholder (for example, other cardholders might share the same personal data, such as birthdate). In at least some implementations, personal/variable data can include some fixed data, as well.

For example, in at least some implementations, personalized data refers to any data that is not pre-printed onto an ID document in advance, so such personalized data can include both data that is cardholder-specific and data that is common to many cardholders. Variable data can, for example, be printed on an information-bearing layer of the ID card using thermal printing ribbons and thermal printheads. Personalized and/or fixed data is also intended to refer to information that is (or can be) cross-linked to other information on the ID document or to the ID document's issuer. For example, personalized data may include a lot number, inventory control number, manufacturing production number, serial number, digital signature, etc. Such personalized or fixed data can, for example, indicate the lot or batch of material that was used to make the ID document, what operator and/or manufacturing station made the ID document and when, etc.

The terms "indicium" and "indicia" as used herein cover not only markings suitable for human reading, but also markings intended for machine reading, and include (but are not limited to) characters, symbols, codes, graphics, images, etc. Especially when intended for machine reading, such an indicium need not be visible to the human eye, but may be in the form of a marking visible only under infra-red, ultra-violet or other non-visible radiation. Thus, in at least some implementations, an indicium formed on any layer in an ID document may be partially or wholly in the form of a marking visible only under non-visible radiation. Markings including, for example, a visible "dummy" image superposed over a non-visible "real" image intended to be machine read may also be used.

"Laminate" and "overlaminate" include but are not limited to materials in film, sheet, and web form. Laminates suitable for at least some implementations include those which contain substantially transparent polymers or which have substantially transparent polymers as a part of their structure. Examples of suitable laminates include polyester, polycarbonate, polystyrene, cellulose ester, polyolefin, polysulfone, polyamide, polyvinyl chloride, and acrylonitrile butadiene styrene. Laminates can be made using either an amorphous polymer (e.g., amorphous polyester) or biaxially oriented polymer (e.g., oriented polyester). The laminate may be a multilayer laminate including three or more layers. In some cases, a multilayer laminate includes a plurality of separate laminate layers, for example, a boundary layer, a film layer, or both.

The degree of transparency of the laminate may be determined at least in part by the information contained within the ID document, the particular colors and/or security features used, etc. The thickness of the laminate layers is not critical, although in some implementations it may be preferred that the thickness of a laminate layer be about 1-20 mil (about 25-500 μm). Types and structures of the laminates described herein are provided only by way of example, those skilled in the art will appreciated that many different types of laminates are suitable.

For example, in ID documents, a laminate can provide a protective covering for the printed substrates and as well as protection against unauthorized tampering (e.g., a laminate would have to be removed to alter the printed information and then subsequently replaced after the alteration). The material(s) from which a laminate is made may be transparent, but need not be. Laminates can include synthetic resin-impregnated or coated base materials composed of successive layers of material bonded together via heat, pressure, or both. As described herein, laminates may be fused polycarbonate structures formed in the absence of adhesives. Laminates also include security laminates, such as a transparent laminate material with proprietary security technology features and processes, which protects documents of value from counterfeiting, data alteration, photo substitution, duplication (including color photocopying), and simulation by use of materials and technologies that are commonly available. Laminates also can include thermosetting materials, such as epoxies.

For purposes of illustration, examples depict various aspects using images that are representative of a bearer of an ID document (e.g., a photographic likeness). However, virtually any indicium can be usable as an "image," which is used herein to include virtually any type of indicium.

In some examples, ID documents can be made of various materials (e.g., TESLIN-core, multi-layered ID documents) and fused polycarbonate structures. Implementations disclosed herein can be applied to many ID document materials formed in many different ways. For example, implementations can be applied to ID materials including, but not limited to, a laminate and/or coating, articles formed from paper, wood, cardboard, paperboard, glass, metal, plastic, fabric, ceramic, rubber, along with many man-made materials, such as microporous materials, single phase materials, two phase materials, coated paper, synthetic paper (e.g., TYVEC, manufactured by DuPont), foamed polypropylene film (including calcium carbonate foamed polypropylene film), plastic, polyolefin, polyester, polyethylene terephthalate (PET), PET-G, PET-F, and polyvinyl chloride (PVC), and combinations thereof.

In other examples, an ID document is fabricated in a platen lamination process, in which component layers of the ID document are fused together with heat, pressure, or both, without adhesives. Platen lamination allows the formation of flat cards with little or no thermal stress, as compared to roll lamination that creates stresses by stretching and laminating in a non-uniform manner. Platen lamination also reduces or eliminates surface interactions due to electrical charge and surface non-evenness, thereby improving card transportation in the card printer. One or more of the component layers may be preprinted (e.g., with invariable data). The resulting ID document is referred to herein as a "card blank" or "blank card." The invariable data may be present as microprint or added in an offset printing process on one of the layers used to construct the card blank.

Different image processing techniques may be used to preprocess an original image that is to be printed as images or graphics on an ID document. For example, different image processing techniques may be used prepare an embedded 3D image, a covert and/or optically variable image (using, for example, covert and/or optically variable media) for printing on an ID document depending on whether the tonality of image reproduction (e.g., printing process) is bitonal (e.g., two tones such as black and white or a first color and second color) or monochromatic (e.g., shaded image, grayscale, etc.). Other optional factors to consider include the viewing methods used with the image, such as reflectance, transmissivity characteristics (e.g., ultraviolet (UV) glowing) and tactility. As used herein, "optically variable device" (OVD) generally refers to an image (e.g., an iridescent image) that exhibits various optical effects such as movement or color changes when viewed.

In some cases, an image may be in digital form, such as resulting from being digitally captured, e.g., via a digital camera, optical sensor, etc., or through scanning a photograph with a scanner, etc. In at least some implementations, this captured image may be refined to produce an intermediate image, which can be transferred (or used to generate an image to be transferred) via laser irradiation to the ID document as a contoured surface image.

In certain cases, monochromatic images (e.g., grayscale images) are used to form contoured surface images. In some implementations, a captured image is processed to bring out or otherwise enhance relevant features found in the captured image. Relevant features of a human face may include the face outline, nose and mouth pattern, ear outline, eye shape, eye location, hairline and shape, etc., or any other feature(s) that have been deemed to be relevant for identification purposes (e.g., particular features used with matching algorithms such as facial recognition algorithms). Once identified, these featured can be "thickened" or otherwise emphasized. The emphasized features can then form a digital version of an image, which can be transferred to an identification card via laser irradiation.

Commercial systems for issuing ID documents are of two main types, namely so-called "central" issue (CI), and so-called "on-the-spot" or "over-the-counter" (OTC) issue. CI type ID documents are not immediately provided to the bearer, but are later issued to the bearer from a central location. For example, in one type of CI environment, a bearer reports to a document station where data is collected, the data are forwarded to a central location where the ID document is produced, and the ID document is forwarded to the bearer, often by mail. Another illustrative example of a CI assembling process occurs in a situation where a driver passes a driving test, but then receives her license in the mail from a CI facility a short time later. Still another illustrative example of a CI assembling process occurs in a situation where a driver renews her license by mail or over the Internet, then receives a driver license card through the mail.

In contrast, a CI assembling process is more of a bulk process facility, where many cards are produced in a centralized facility, one after another. For example, a situation where a driver passes a driving test, but then receives her license in the mail from a CI facility a short time later. The CI facility may process thousands of cards in a continuous manner.

CI ID documents can be produced from digitally stored information and generally include an opaque core material (also referred to as "substrate"), such as paper or plastic, sandwiched between two layers of clear plastic laminate, such as polyester, to protect the aforementioned items of information from wear, exposure to the elements and tampering. The materials used in such CI ID documents can offer durability. In addition, centrally issued digital ID documents may offer a higher level of security than OTC ID documents because they offer the ability to print the variable data directly onto the core of the CI ID document which then joins the variable data in intimate contact with the preprinted features. Security features such as "micro-printing," ultraviolet security features, security indicia and other features are currently used in both OTC and CI ID documents. In the case of the OTC documents, in some examples, the preprinting is rarely if ever presented so that the preprinted features come into direct contact with the variable data, which typically on the outside of the card. This may make the OTC variety less secure than other CI variants that bring the two printing processes in contact.

In addition, a CI assembling process can be more of a bulk process facility, in which many ID documents are produced in a centralized facility, one after another. The CI facility may, for example, process thousands of ID documents in a continuous manner. Because the processing occurs in bulk, CI can have an increase in efficiency as compared to some OTC processes, especially those OTC processes that run intermittently. Thus, CI processes can sometimes have a lower cost per ID document, if a large volume of ID documents are manufactured.

In contrast to CI ID documents, OTC ID documents are issued immediately to a bearer who is present at a document-issuing station. An OTC assembling process provides an ID document "on-the-spot". An illustrative example of an OTC assembling process is a Department of Motor Vehicles ("DMV") setting where a driver license is issued to person, on the spot, after a successful exam. In some instances, the very nature of the OTC assembling process results in small, sometimes compact, printing and card assemblers for printing the ID document. An OTC card issuing process can be by its nature an intermittent process in comparison to a continuous process.

OTC ID documents of the types mentioned above can take a number of forms, depending on cost and desired features. Some OTC ID documents comprise highly plasticized poly(vinyl chloride) or have a composite structure with polyester laminated to 0.5-2.0 mil (about 13-51 μm) poly(vinyl chloride) film, which provides a suitable receiving layer for heat transferable dyes which form a photographic image, together with any variant or invariant data required for the identification of the bearer. These data are subsequently protected to varying degrees by clear, thin overlay patches (0.125-0.250 mil, or about 3-6 μm) applied at the printhead, holographic hot stamp foils (0.125-0.250 mil, or about 3-6 μm), or a clear polyester laminate (0.5-10 mil, or about 13-254 μm) supporting common security features. These last two types of protective foil or laminate sometimes are applied at a laminating station separate from the printhead. The choice of laminate dictates the degree of durability and security imparted to the system in protecting the image and other data.

One response to the counterfeiting of ID documents includes the integration of verification features that are difficult to copy by hand or by machine, or which are manufactured using secure and/or difficult to obtain materials. One such verification feature is the use in the ID document of a signature of the ID document's issuer or bearer. Other verification features have involved, for example, the use of contoured surface images, watermarks, biometric information, microprinting, covert materials or media (e.g., ultraviolet (UV) inks, infrared (IR) inks, fluorescent materials, phosphorescent materials), optically varying images, fine line details, validation patterns or marking, and polarizing stripes. These verification features are integrated into an ID document in various ways and they may be visible (e.g., contoured surface images) or invisible (covert images) in the finished card. If invisible, they can be detected by viewing the feature under conditions which render it visible (e.g., UV or IR lights, digital watermark readers). At least some of the verification features discussed above have been employed to help prevent and/or discourage counterfeiting.

Contoured Surface Images

FIG. 1A depicts an exemplary ID document 100 with contoured surface image 102 viewed from the front 104 in reflected light from light source 108. ID document 100 may be an OTC or CI ID document. Contoured surface image 102 is visible to the unaided human eye. As depicted, contoured surface image 102 is formed from digital color portrait image 106, however, the contoured surface image 102 can be an image of other ID information or other personal credentials, including text, graphical patterns, images, and the like. Contoured surface image 102 is formed in the outer surface of ID document 100 and partially overlaps portrait 106.

Figure 1B:
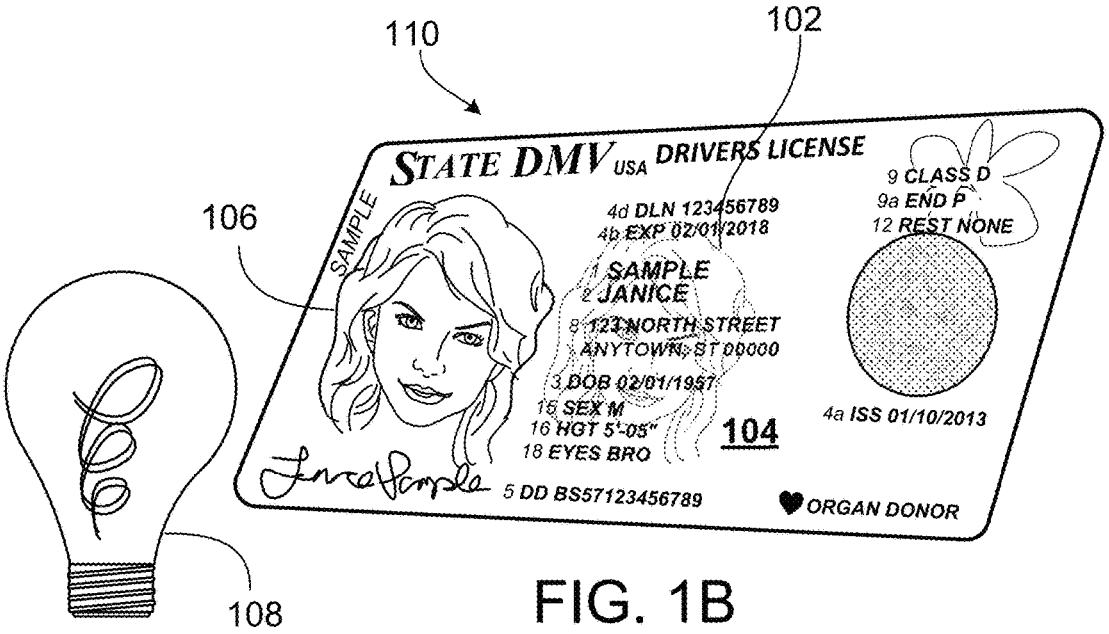

FIG. 1B depicts ID document 110 with contoured surface image 102 viewed as in FIG. 1A, with contoured surface image 102 spatially separated from (i.e., does not overlap) portrait 106. In some cases, contoured surface image 102 may be aligned with (superimposed over) portrait 106.

Figure 1C:
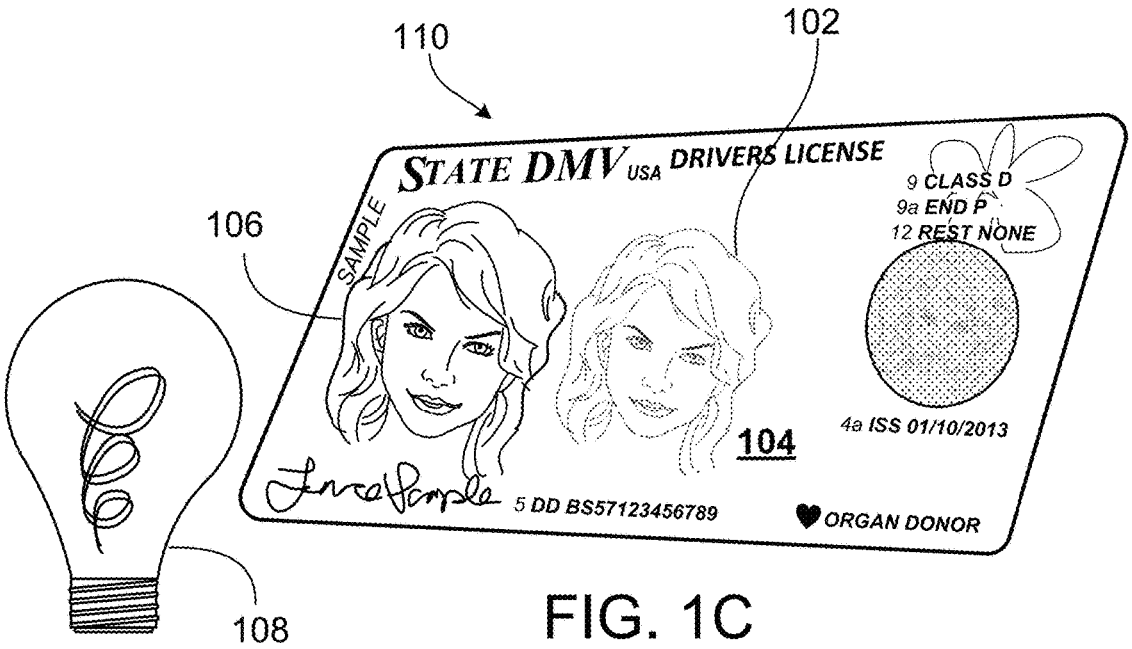

FIG. 1C depicts ID document 120, in which contoured surface image 102 does not overlay variable indicia on the ID document. The area of ID document 120 over which contoured surface image 102 is formed need not be a substantially blank area of the ID document; for example, the area could contain fixed indicia such as background colors, fine line printing, artwork, scrolls, etc.

Features of contoured surface image 102 vary in height, such that the contoured surface image is perceptible by touch (e.g., by translating a fingertip in contact with the surface of the ID document over the contoured surface image). Contoured surface image 102 is free of pixel patterns that are visible to the unaided human eye.

Figure 2:
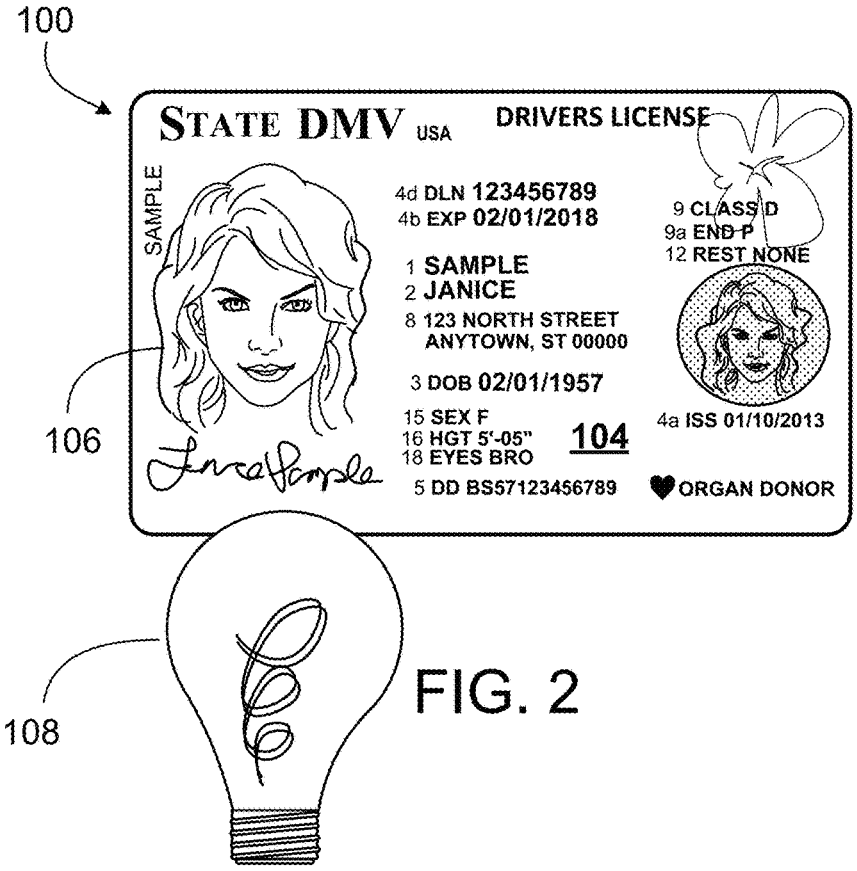
FIG. 2 depicts the ID document of FIG. 1A viewed from the front in reflected light at a second, different angle.

FIG. 2 depicts ID document 100 viewed from front 104 at a different angle from that shown in FIGS. 1A-1C. As depicted in FIG. 2, contoured surface image 102 is not visible to the unaided human eye.

When viewed from a first angle (e.g., in directly reflected light as shown in FIG. 2) the contoured surface image may be invisible to the unaided human eye, and when viewed from a second angle (e.g., in indirectly reflected light as shown in FIGS. 1A-1C) the contoured surface image 102 may be visible to the unaided human eye. For example, when viewed from a first angle (e.g., in indirectly reflected light) the contoured surface image 102 is visible to the unaided human eye and appears in outline (e.g., as shown in FIGS. 1A-1C). When viewed from a second angle (e.g., in directly reflected light as shown in FIG. 2) the contoured surface image 102 is not visible to the unaided human eye. That is, contoured surface image 102 is visible in reflected light at greater and lesser intensity based on the angle of reflection. By way of example, contoured surface image 102 is less visible at the angle of reflection in FIG. 2 than at the angle of reflection in FIGS. 1A-1C. Tilting the ID document in reflected light causes contoured surface image 102 to appear more or less visible.

In some examples, contoured surface image 102 can overlap a significant portion of corresponding portrait 106, thereby linking and layering with that feature. In some examples, close alignment of the contoured surface image 102 to a corresponding portrait 106 is optional. In some examples, contoured surface image 102 can be applied so as to partially overlay a variable indicium on the ID document 100 as depicted in FIG. 1A, and the variable indicium need not be the same indicium as contoured surface image 102. In some examples, contoured surface image 102 can be applied to an ID document so that it does not overlay a variable indicium on an ID document 100, as depicted in FIG. 1C.

Figure 3:
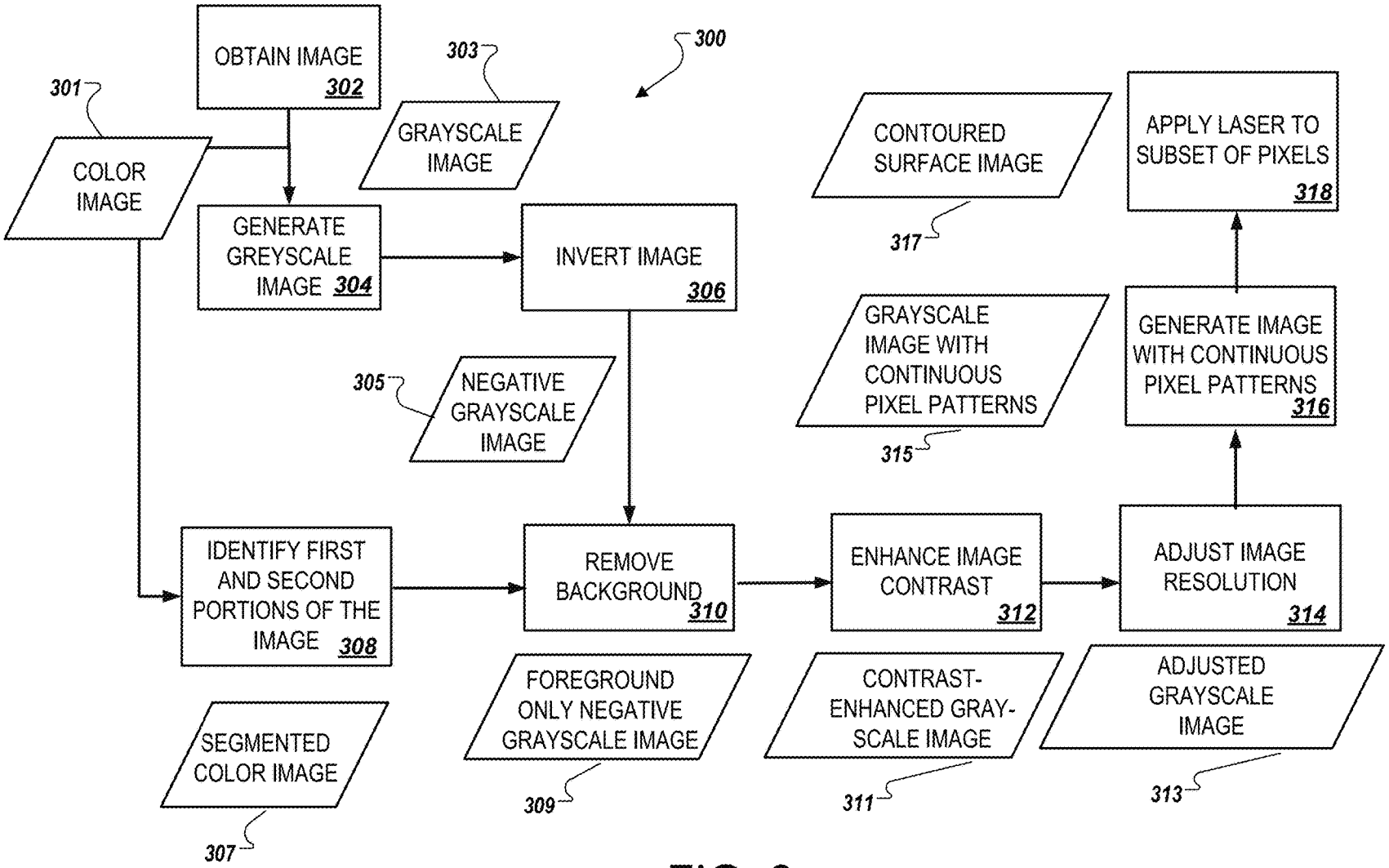
FIG. 3 depicts a flowchart of a process for generating an ID document with a contoured surface image.

FIG. 3 depicts a flowchart of an exemplary process 300 for generating a contoured surface image in an ID document that can be executed in accordance with implementations of the present disclosure. In some implementations, process 300 can be realized using one or more computer-executable programs that are executed using one or more computing devices. In some implementations, process 300 can be executed using one or more computing devices to control identification document printing equipment. One or more operations in process 300 may be omitted. In some cases, process 300 may include one or more additional operations. In certain cases, the order of the operations in process 300 may be altered.

Image 301 is obtained (302). For example, image 301 can be a color or grayscale image. Image 301 can be, for example, an image of the cardholder (e.g., a portrait), an image of a building (e.g., a state capital), or an image of textual information (e.g., an ID number or a security code). Image 301 can be obtained from an ID issuing authority (e.g., a state department of motor vehicles), cardholder database or a cardholder's application for an ID (e.g., driver license or passport application). In some examples, image 301 can be an image of personalized credential information (e.g., information that is specific to an ID cardholder, such as a portrait). In some examples, image 301 can be specific to an ID issuing authority (e.g., an image of a capital building).

Image 301, if not initially a grayscale image, is converted to grayscale image 303 (304). For example, if image 301 was obtained as a color image, color image 301 can be converted to grayscale image 303. Greyscale image 303 is inverted (306). For example, "negative" greyscale image 305 can be generated. For example, the pixel values of the greyscale image can be inverted. In other words, for an 8-bit image a pixel value of 255 can be inverted to become 0, or a pixel value of 55 can be inverted to become 200. In some examples, the bits of each pixel in greyscale image 303 can be complemented (e.g., 00110111b (55) becomes 11001000b (200)).

In addition, a first portion and a second portion of image 301 (color or grayscale) are identified (308). For example, the first portion may correspond to the foreground object in the image (e.g., a portrait or face of a bearer), and the second portion may correspond to the background of image 301 or other objects in image 301. For example, image 301 can be segmented to produce segmented image 307. For example, segmenting image 301 can distinguish the background of image 301 from an object in the image that is to be used for the contoured image. For example, an object detection algorithm can be performed on image 301 to detect an object (e.g., a face in a portrait or a budding) and segment the objects in image 301. For example, boundary contours of between the object and the background in the image can be detected and delineated (e.g., based on color, contrast, or user selected contours), thereby, segmenting the object from the background and other objects in image 301. In some examples, a facial detection algorithm can be used to segment a bearer's face in a portrait of the bearer.

The background is removed (310) from "negative" greyscale image 305 yielding a modified "negative" greyscale image 309 (e.g., foreground only "negative" greyscale image). For example, segmented image 307 can be used to identify and remove the background in "negative" greyscale image 305. In some examples, the pixels in the background segment(s) of segmented image 307 can be mapped to corresponding pixels in "negative" greyscale image 305 to identify background pixels in "negative" greyscale image 305. In some examples, segmented image 307 serves as a mask for removing the background from "negative" greyscale image 305. The background pixels in "negative" greyscale image 305 can be removed from the image. In some examples, the background pixels are removed or made transparent. In some examples, the background pixels are assigned a value identifying them as background pixels such that they will not be printed. The resulting modified "negative" greyscale image 309 can include only a "negative" greyscale image of the desired object. In other words, the resulting modified "negative" greyscale image 309 can include only the object of which a contoured surface image is to be generated (e.g., a bearer's portrait).

In some cases, contrast-enhanced grayscale image 311 is generated (312) from the modified "negative" greyscale image 309. For example, grayscale image 309 may be processed to bring out or otherwise enhance relevant features found in the captured image. Relevant features of a human face may include the face outline, nose and mouth pattern, ear outline, eye shape, eye location, hairline and shape, etc., or any other feature(s) that have been deemed to be relevant for identification purposes (e.g., particular features used with matching algorithms such as facial recognition algorithms). Once identified, these featured can be "thickened" or otherwise emphasized. The emphasized features can then form contrast-enhanced grayscale image 311.

The image resolution of grayscale image 309 or 311 may be adjusted (314), for example, by adding more pixels using interpolation to increase the image resolution or subtracting pixels to reduce the resolution to yield adjusted grayscale image 313, suitable for the intended document size and the precision of the laser used to form the contoured surface image in the ID document.

A digital monochrome (grayscale) image 315 is generated (316) with continuous pixel patterns from grayscale image 303, 305, 309, 311, or 313. This can be done using an image dithering algorithm that results in more continuous pixel patterns, or more connections between color pixels. In one example, the Jarvis-Judice-Ninke image dithering algorithm diffuses the error to twelve neighboring pixels, which results in high fidelity dithering with continuous pixel patterns. Other dithering techniques include, for example, Floyd-Steinberg dithering, Atkinson dithering, Sierra dithering, Sierra Lite dithering, Halftone, and the like.

The surface of an ID document is irradiated with a laser using digital monochrome image 315 as a guide. The laser (e.g., a $CO_2$ laser) is applied to all regions labelled as "dark" (e.g., the black pixels). The affected area of each laser beam application is typically slightly larger than the physical pixel size of the digital monochrome image. The laser energy level and speed are adjusted according to the ID document material and the desired depth of the contoured surface image. Generally, laser parameters are selected such that at least some of the material in the surface of the ID document is ablated, and some of the energy is absorbed by the outer layer of the ID document as thermal energy, such that polymeric material in the outer layer is melted and flows from one pixel in the digital monochrome image to one or more adjacent or directly adjacent (abutting) pixels. The combination of ablation and heat absorption creates a smooth surface that is correlated to the image in topographical content. When the affected area is slightly larger than the physical pixel size, the neighboring pixels are melted into each other when the laser beam is applied. As such, a smooth contoured ("sculpted") image having a glass-like appearance is created on the document surface, and no pixilation in the contoured surface image is visible to the unaided human eye.

Figure 4:
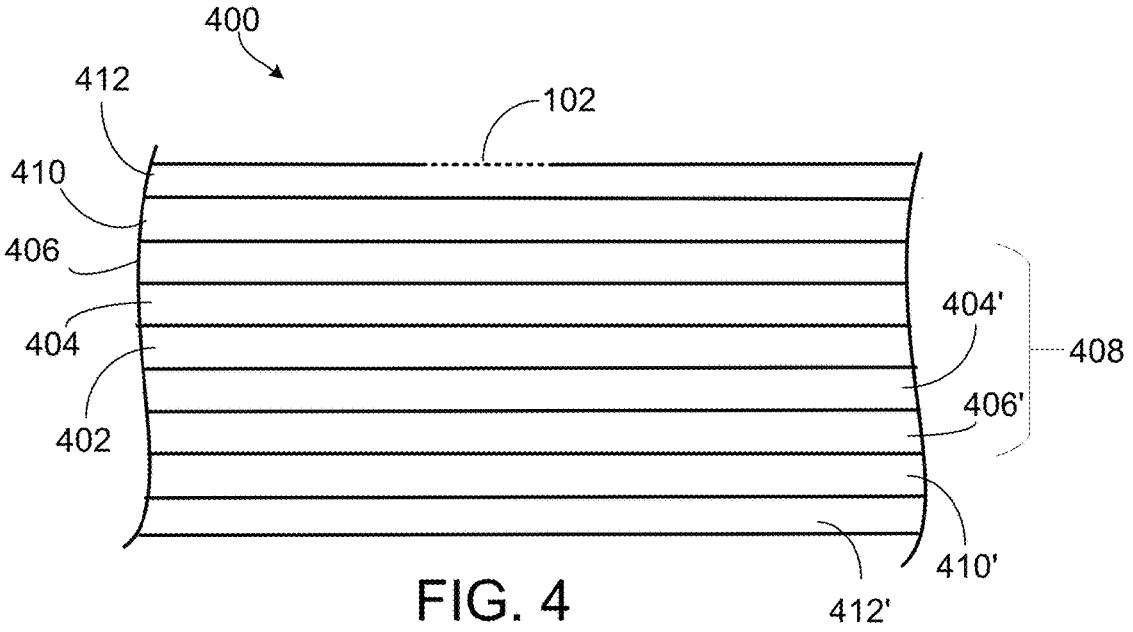
FIG. 4 is a cross-sectional view of an over-the-counter ID document with a contoured surface image.

Although a contoured surface image may be formed in ID documents having variety of configurations, a contoured surface image may be formed in an OTC ID document, such as exemplary OTC ID document 400 depicted in FIG. 4. FIG. 4 is a cross-sectional view of ID document 400 taken through contoured surface image 102 in the outer surface of the ID document. ID document 400 includes core layer 402, tie layers 404, 404' on either side of the core layer, and structural layers 406, 406' on the outer side of tie layers 404, 404', respectively. Core layer 402 is opaque, and may be preprinted on one or both sides (e.g., with invariable data). One or more of tie layers 404, 404' may also be preprinted, engraved, or both. Tie layers 404, 404' typically include multiple co-extruded layers and promote bonding between core layer 402 and structural layers 406, 406'. Structural layers 406, 406' provide durability as well as stiffness and flatness. Tamper-evident (TE) patterns may be coated onto structural layers 406, 406' via gravure. After assembly (e.g., manually or via machine), core layer 402, tie layers 404, 404', and structural layers 406, 406' are laminated in a platen lamination process to yield card blank 408, formed in the absence of adhesive compositions. The platen lamination process facilitates debossing, as well as the flatness, superior surface finish, and desired polish for card blank 408.

Receiver layers 410, 410' may be coated on the outer side of each structural layer 406, 406', respectively, and may be bonded to the structural layers via solvent dissolution, thereby becoming part of the structural layers. Tamper-evident patterns may be coated on an underside of one or more of receiver layers 410, 410'. Receiver layers 410, 410' allow good image replication (e.g., via D2T2) as well as debossing. Patterns formed by plate debossing go through the D2T2 receiver layer and into the structural layer underneath, thereby providing protection of the image, photo, or text (as applicable) from tampering or counterfeiting. Overlaminate layers 412, 412' may be coated on receiver layers 410, 410', respectively, after personalization. Overlaminate layer 412 represents front 104 of ID document 100, and overlaminate layer 412' represents the back of the ID document. Receiver layers 410, 410' and overlaminate layers 412, 412' are not considered to be part of the card blank. Thus, card blank 408 has five layers, including core layer 402, tie layers 404, 404', and structural layers 406, 406'. Contoured surface image 102 defines a depression in overlaminate layer 412.

Core layer 402 is typically opaque. Suitable materials for core layer 402 include white poly(vinyl chloride) (PVC), polyester, polycarbonate, polystyrene, and the like. TESLIN and other polymers that are capable of z-axis tear out and are immiscible with other polymers are typically not suitable for core layer 402. A thickness of core layer 402 is typically in a range of 5 to 10 mil (about 125 to 250 μm). Fixed indicia may be printed (or pre-printed) on core layer 402. The core layer in at least some embodiments is formed using a material adapted to be printable or markable (e.g., by laser marking) using a desired printing/marking technology. Materials that are printable can include, as an example, materials such as polyolefin, polyester, polycarbonate (PC), PVC, plastic, polyethylene terephthalate (PET), polyethylene terephthalate glycol-modified (PETG), polyethylene terephthalate film (PETF), and combinations thereof. However, materials that can split in the z-axis are typically not suitable. Many other materials are, of course, suitable, as those skilled in the art will appreciate. In an advantageous embodiment, core layer 402 is substantially opaque, which can enable printing on one side to be not viewable from the other side, but opacity is not required. In some embodiments, it may, in fact, be advantageous that core layer 402 be substantially transparent. The color of the core layer 402 may vary, but in an advantageous embodiment the core layer is colored to provide a good contrast with indicia printed (or otherwise formed) thereon. In one example, core layer 402 is light in color, thereby allowing good contrast with dark indicia. In another example, core layer 402 is dark in color, thereby allowing good contrast with light indicia.

Tie layers 404, 404' typically include multiple layers of chemically modified resins with reactive moieties (e.g., isocyanates) attached to the base resin. The reactive moieties in an outer layer of a tie layer are selected form covalent bonds with the layer in contact with the tie layer during lamination. Suitable materials for tie layers 404, 404' are compatible with other materials in the ID document and include PETG and PC. A thickness of tie layers 404, 404' is typically in a range of 2 to 6 mil (about 50 to 150 μm). Thickness, composition, or both of tie layers 404 and 404' may be the same or different. In some cases, a laser engraved image (e.g., a hologram or KINEGRAM) is formed in one or more of tie layers 404, 404' (e.g., in tie layer 404).

Suitable materials for structural layers 406, 406' include PC, polyethers, polyphenoxides, polyphenols, polyesters, polyurethanes, and the like. Structural layers 406, 406' may be sensitized to accept laser engraving. A thickness of structural layers 406, 406' is typically in a range of 2 mil to 10 mil (about 50 μm to about 250 μm). Thickness, composition, or both of structural layers 406, 406' may be the same or different.

Suitable materials for receiver layers 410, 410' include PC (e.g., non-sensitized), coated with, for example, modified PVC with antioxidants. The receiver coating allows good image replication and using deboss patterns promotes protection of printed features (e.g., images, text) from tampering, counterfeiting, or both. A thickness of receiver layers 410, 410' is typically in a range of 4 to 10 mil (about 100 to about 250 μm). Thickness, composition, or both of receiver layers 410, 410' may be the same or different.

Suitable materials for overlaminates 412, 412' include polyester, polycarbonate, polystyrene, cellulose ester, polyolefin, polysulfone, polyamide, polyvinyl chloride, and acrylonitrile butadiene styrene. Laminates can be made using either an amorphous polymer (e.g., amorphous polyester) or biaxially oriented polymer (e.g., oriented polyester). Contoured surface image 102 in overlaminate 412 is formed in the overlaminate as described herein, yielding a clear, smooth topographical feature with a glass-like appearance and having no pixelation visible to the unaided human eye.

If two directly adjacent layers are made of substantially the same material (e.g., polycarbonate), they may be laminated together into a single structure, as understood by those skilled in the art. Similarly, if a laminate and an overlaminate are both made of the same material (e.g., polycarbonate), they can be laminated into a single structure.

In one example, card blank 408 includes layers 402, 404, 404', and 406, 406', as defined below.

Structural layer 406: 7 mil polycarbonate (PC) (non-sensitized);

Tie layer 404: 5 mil five-layer co-extruded tie layer (e.g., PETG/PETG+PC/PC/PETG+PC/PETG);

Core layer 402: 6 mil white polyvinyl chloride (PVC) with window;

Tie layer 404': 5 mil five-layer coextruded tie layer (e.g., PETG/PETG+PC/PC/PETG+PC/PETG); and Structural layer 406': 7 mil PC (non-sensitized).

Receiver layers 410, 410' (e.g., 2-6 mil D2T2 receiver layers) may be coated on structural layers 406, 406', respectively, prior to personalization. The card blank may be personalized in a CI or OTC setting and the printed card may be overlaminated. In one example, overlaminate layers 412, 412' may be printed over receiver layers 410, 410', respectively, with a desktop (e.g., D2T2) printer or large in-line printer or laminator (e.g., Datacard MX-6100).

Figure 5:
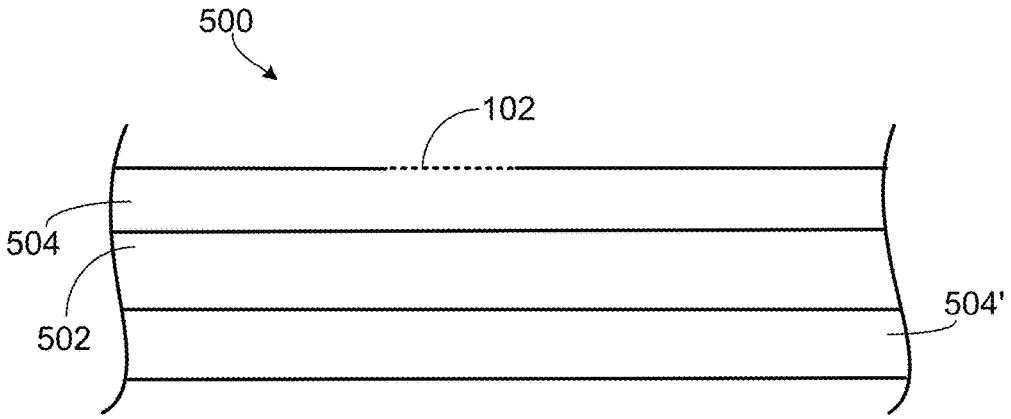
FIG. 5 is a cross-sectional view of a centrally issued ID document with a contoured surface image.

In some implementations, a contoured surface image may be formed in a CI ID document, such as exemplary CI ID document 500 depicted in FIG. 5. FIG. 5 is a cross-sectional view of ID document 500 taken through contoured surface image 102 in the outer surface of the ID document. ID document 500 includes core layer 502 sandwiched between layers 504 and 504'. Core layer 502 is typically an opaque material (also referred to as "substrate"), such as paper or plastic. Core layer 502 may include fixed and variable data, such as a color portrait, text, 2-D barcode, and the like. Layers 504 and 504' are typically clear plastic laminate that serve to protect the aforementioned items of information from wear, exposure to the elements and tampering. The thickness of layers 504 and 504' is not critical, although in some implementations it may be preferred that the thickness of a laminate layer be about 1-20 mil (about 25-500 μm). In one example, a thickness of layers 504 and 504' is about 10 mil. Examples of suitable laminates include polyester, polycarbonate, polystyrene, cellulose ester, polyolefin, polysulfone, polyamide, polyvinyl chloride, and acrylonitrile butadiene styrene. Laminates can be made using either an amorphous polymer (e.g., amorphous polyester) or biaxially oriented polymer (e.g., oriented polyester). Contoured surface image 102 defines a depression in layer 504.

Figure 6A:
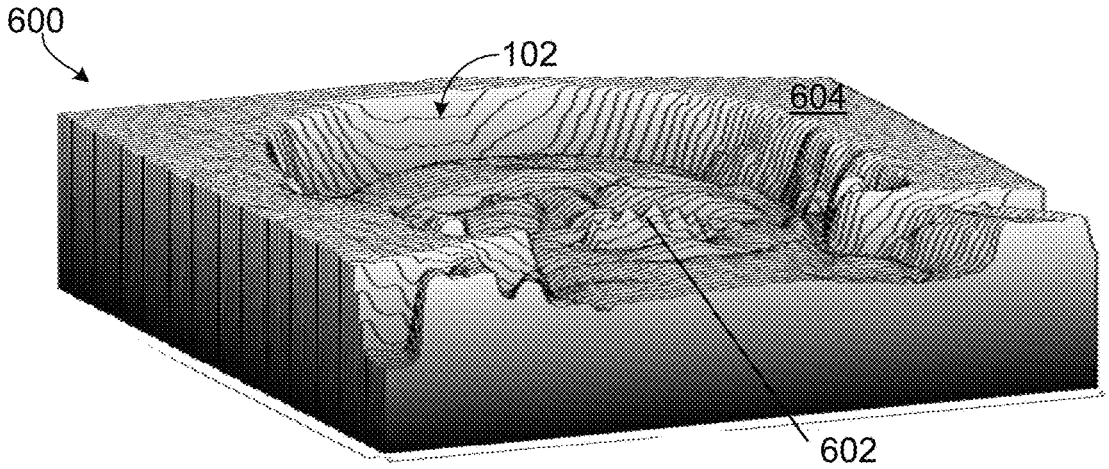
FIG. 6A shows a perspective cross-sectional view of a contoured surface image based on the image of FIG. 6B.
Figure 6B:
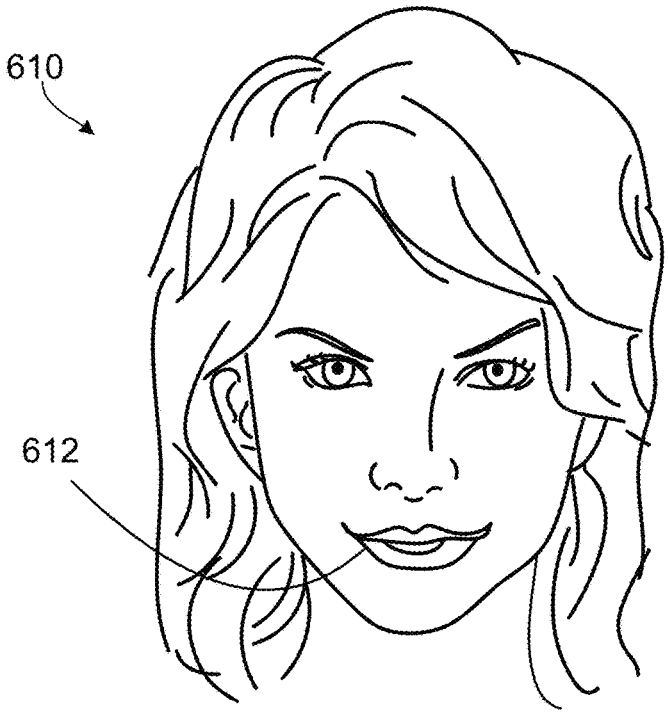

FIG. 6A is a perspective cross-sectional view of a portion of ID document 600 taken through contoured surface image 102. Contoured surface image 102 corresponds to image 610 in FIG. 6B, with features (e.g., mouth 602) of the contoured surface image corresponding to features (e.g., mouth 612) of image 610. Contoured surface image 102 defines a depression in the outer layer of ID document 600, with contours of the depression corresponding to contours in the image. In some examples, contoured surface image 102 has a depth from a surface of outer layer 604 in a range between 1 μm and 50 μm.

In one example, an image is processed as described with respect to process 300 depicted in FIG. 3, and a PowerLine C 30 $CO_2$ laser available from Rofin (Germany) is used with the settings listed in Table 1 to form a contoured surface image in the outer amorphous polyester surface layer of a CI ID document

TABLE 1

Laser settings for contoured surface image.

| | | |
|---|---|---|
| LASER | Pumping power | 15.0% |
| | Frequency: | 20,000 Hz |
| | Speed: | 200 mm/s |
| | Pulse width: | 10.0 μs |
| | Line width | 0.200 mm |
| GALVO | Maximum: | 1.000 ms |
| | Minimum: | 0.5000 ms |
| | Saturation after: | 5.000 mm |
| | Jump Speed: | 12500 mm/s |
| RASTER | Pos. Comp: | 2.10 |
| | DAC min: | 0 |
| | DAC max: | 1000 |

TABLE 1-continued

Laser settings for contoured surface image.

| | | |
|---|---|---|
| DELAY BEAM | Beam on delay: | 0.150 ms |
| | Beam off delay: | 0.00 ms |
| | Corner: | 0.00 ms |
| | On the fly begin: | 0.00 ms |
| | On the fly end: | 0.00 ms |

While many of the figures shown herein illustrate a particular example of an ID document (e.g., a driver license), the scope of this disclosure is not so limited. Rather, methods and techniques described herein, apply generally to all ID documents defined above. Moreover, techniques described herein are applicable to non-ID documents, such as embedding 3D images in features of ID documents. Further, instead of ID documents, the techniques described herein can be employed with product tags, product packaging, business cards, bags, charts, maps, labels, etc. The term ID document is broadly defined herein to include these tags, labels, packaging, cards, etc. In addition, while some of the examples above are disclosed with specific core components, it is noted that laminates can be sensitized for use with other core components. For example, it is contemplated that aspects described herein may have applicability for articles and devices such as compact disks, consumer products, knobs, keyboards, electronic components, decorative or ornamental articles, promotional items, currency, bank notes, checks, or any other suitable items or articles that may record information, images, and/or other data, which may be associated with a function and/or an object or other entity to be identified.

Further modifications and alternative implementations of various aspects will be apparent to those skilled in the art in view of this description. For example, while some of the detailed implementations described herein use UV, IR, thermachromic, and optically variable inks and/or dyes by way of example, the present disclosure is not so limited. Accordingly, this description is to be construed as illustrative only. It is to be understood that the forms shown and described herein are to be taken as examples of implementations. Elements and materials may be substituted for those illustrated and described herein, parts and processes may be reversed, and certain features may be utilized independently, all as would be apparent to one skilled in the art after having the benefit of this description.

Implementations of the subject matter and the functional operations described in this specification can be implemented in digital electronic circuitry, in tangibly-implemented computer software or firmware, in computer hardware, including the structures disclosed in this specification and their structural equivalents, or in combinations of one or more of them. Implementations of the subject matter described in this specification can be implemented as one or more computer programs, i.e., one or more modules of computer program instructions encoded on a tangible non transitory program carrier for execution by, or to control the operation of, data processing apparatus. The computer storage medium can be a machine-readable storage device, a machine-readable storage substrate, a random or serial access memory device, or a combination of one or more of them.

The term "data processing apparatus" refers to data processing hardware and encompasses all kinds of apparatus, devices, and machines for processing data, including, by way of example, a programmable processor, a computer, or multiple processors or computers. The apparatus can also be or further include special purpose logic circuitry, e.g., a central processing unit (CPU), a FPGA (field programmable gate array), or an ASIC (application specific integrated circuit). In some implementations, the data processing apparatus and/or special purpose logic circuitry may be hardware-based and/or software-based. The apparatus can optionally include code that creates an execution environment for computer programs, e.g., code that constitutes processor firmware, a protocol stack, a database management system, an operating system, or a combination of one or more of them. The present disclosure contemplates the use of data processing apparatuses with or without conventional operating systems, for example Linux, UNIX, Windows, Mac OS, Android, iOS or any other suitable conventional operating system.

A computer program, which may also be referred to or described as a program, software, a software application, a module, a software module, a script, or code, can be written in any form of programming language, including compiled or interpreted languages, or declarative or procedural languages, and it can be deployed in any form, including as a stand-alone program or as a module, component, subroutine, or other unit suitable for use in a computing environment. A computer program may, but need not, correspond to a file in a file system. A program can be stored in a portion of a file that holds other programs or data, e.g., one or more scripts stored in a markup language document, in a single file dedicated to the program in question, or in multiple coordinated files, e.g., files that store one or more modules, sub programs, or portions of code. A computer program can be deployed to be executed on one computer or on multiple computers that are located at one site or distributed across multiple sites and interconnected by a communication network. While portions of the programs illustrated in the various figures are shown as individual modules that implement the various features and functionality through various objects, methods, or other processes, the programs may instead include a number of submodules, third party services, components, libraries, and such, as appropriate. Conversely, the features and functionality of various components can be combined into single components as appropriate.

The processes and logic flows described in this specification can be performed by one or more programmable computers executing one or more computer programs to perform functions by operating on input data and generating output. The processes and logic flows can also be performed by, and apparatus can also be implemented as, special purpose logic circuitry, e.g., a central processing unit (CPU), a FPGA (field programmable gate array), or an ASIC (application specific integrated circuit.

Computers suitable for the execution of a computer program include, by way of example, can be based on general or special purpose microprocessors or both, or any other kind of central processing unit. Generally, a central processing unit will receive instructions and data from a read only memory or a random access memory or both. The essential elements of a computer are a central processing unit for performing or executing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device, e.g., a universal serial bus (USB) flash drive, to name just a few.

Computer readable media (transitory or non-transitory, as appropriate) suitable for storing computer program instructions and data include all forms of nonvolatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The memory may store various objects or data, including caches, classes, frameworks, applications, backup data, jobs, web pages, web page templates, database tables, repositories storing business and/or dynamic information, and any other appropriate information including any parameters, variables, algorithms, instructions, rules, constraints, or references thereto. Additionally, the memory may include any other appropriate data, such as logs, policies, security or access data, reporting files, as well as others. The processor and the memory can be supplemented by, or incorporated in, special purpose logic circuitry.

To provide for interaction with a user, implementations of the subject matter described in this specification can be implemented on a computer having a display device, e.g., a CRT (cathode ray tube), LCD (liquid crystal display), or plasma monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

The term "graphical user interface," or GUI, may be used in the singular or the plural to describe one or more graphical user interfaces and each of the displays of a particular graphical user interface. Therefore, a GUI may represent any graphical user interface, including but not limited to, a web browser, a touch screen, or a command line interface (CLI) that processes information and efficiently presents the information results to the user. In general, a GUI may include a plurality of user interface (UI) elements, some or all associated with a web browser, such as interactive fields, pull-down lists, and buttons operable by the business suite user. These and other UI elements may be related to or represent the functions of the web browser.

Implementations of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network (LAN), a wide area network (WAN), e.g., the Internet, and a wireless local area network (WLAN).

The computing system can include clients and servers. A client and server are generally remote from each other and typically interact through a communication network. The relationship of client and server arises by virtue of computer programs running on the respective computers and having a client-server relationship to each other.

While this specification contains many specific implementation details, these should not be construed as limitations on the scope of any invention or on the scope of what may be claimed, but rather as descriptions of features that may be specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable sub-combination. Moreover, although features may be described above as acting in certain combinations and even initially claimed as such, one or more features from a claimed combination can in some cases be excised from the combination, and the claimed combination may be directed to a subcombination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be helpful. Moreover, the separation of various system modules and components in the implementations described above should not be understood as requiring such separation in all implementations, and it should be understood that the described program components and systems can generally be integrated together in a single software product or packaged into multiple software products.

Particular implementations of the subject matter have been described. Other implementations, alterations, and permutations of the described implementations are within the scope of the following claims as will be apparent to those skilled in the art. For example, the actions recited in the claims can be performed in a different order and still achieve desirable results.

Accordingly, the above description of example implementations does not define or constrain this disclosure. Other changes, substitutions, and alterations are also possible without departing from the spirit and scope of this disclosure.

What is claimed is:

1. A multilayer laminate identification document comprising:

an outer layer comprising a contoured surface image formed via laser ablation and having contours based on a digital monochrome image, wherein the contoured surface image has a first appearance when viewed in reflected light at a first angle and a second, different appearance when viewed in reflected light at a second, different angle; and an inner layer having a source image printed thereon, wherein the digital monochrome image is derived from the source image, and the contoured surface image partially overlaps the source image wherein the source image is a digital polychrome portrait of a subject.

2. The identification document of claim 1, wherein the contoured surface image is perceptible by touch.

3. The identification document of claim 1, wherein the contours of the contoured surface image do not appear pixelated to the unaided human eye.

4. The identification document of claim 1, wherein the contours are continuous, and correspond to contiguous pixels in the digital monochrome image.

5. The identification document of claim 1, wherein the contoured surface image defines a depression in the outer layer.

* * * * *